US007451495B2

(12) United States Patent
Munn et al.

(10) Patent No.: US 7,451,495 B2
(45) Date of Patent: Nov. 18, 2008

(54) COMBINED GARMENT AND SAFETY HARNESS

(75) Inventors: Gary Munn, Destin, FL (US); Eamonn McCann, Keady (GB); Paul McCann, Keady (GB); Louise Jordan, Coolshanagh (GB)

(73) Assignee: Celtic Ties Limited, Blanchardstown, Dublin (IE)

( * ) Notice: Subject to any disclaimer, the term of this patent is extended or adjusted under 35 U.S.C. 154(b) by 544 days.

(21) Appl. No.: 10/912,435

(22) Filed: Aug. 5, 2004

(65) Prior Publication Data

US 2005/0278819 A1 Dec. 22, 2005

(30) Foreign Application Priority Data

Jun. 3, 2004 (IE) ..... S2004/0386

(51) Int. Cl.
*A62B 35/00* (2006.01)

(52) U.S. Cl. ..... 2/94; 2/69; 2/102; 2/311; 182/9

(58) Field of Classification Search ..... 2/69, 2/94, 102, 311; 182/3, 9
See application file for complete search history.

(56) References Cited

U.S. PATENT DOCUMENTS 6,035,440 A * 3/2000 Woodyard ..... 2/102
6,101,631 A * 8/2000 Ferguson, Jr. ..... 2/94
6,128,782 A 10/2000 Young et al.
6,256,789 B1 7/2001 Young et al.
6,658,666 B2 * 12/2003 Schweer ..... 2/94
6,874,596 B2 * 4/2005 Zeissler et al. ..... 182/3
2003/0173150 A1 * 9/2003 Sharp ..... 182/3
2006/0054387 A1 * 3/2006 Fortin ..... 182/3

FOREIGN PATENT DOCUMENTS

DE 29919016 U1 12/1999
EP 0744192 A2 11/1996
WO WO0053038 9/2000

* cited by examiner

*Primary Examiner*—Gary L. Welch
*Assistant Examiner*—Alissa J Tompkins
(74) *Attorney, Agent, or Firm*—Thompson Coburn LLP; Clyde L. Smith, Esq.

(57) ABSTRACT

A combined garment and safety harness is disclosed that comprises a garment portion and a harness portion. The garment portion comprises a back torso portion and a front torso portion and has left and right arm openings, left and right leg openings, and a neck opening. Additionally, the harness portion comprises a webbing and an attachment member that are secured to each other. The webbing comprises a plurality of interconnected strap members and forms a closed loop around and adjacent the left leg opening of the garment portion and a separate closed loop around and adjacent the right leg opening. The webbing is secured to the garment portion. At least a portion of harness portion extends through the back torso portion of the garment portion.

11 Claims, 5 Drawing Sheets

COMBINED GARMENT AND SAFETY HARNESS

This application claims priority to the Irish Short-Term Patent Application No. S2004/0386, which was filed with the European Patent Office on Jun. 3, 2004.

BACKGROUND OF THE INVENTION

This invention pertains to the field of safety harnesses. More particularly, this invention pertains to the field of safety harnesses that are attached to garments.

In many occupations or situations, it is desirable for workers or others to wear safety harnesses so as to reduce the risk of injury caused by accidental falls. As a result, many types of safety harnesses have been developed. Additionally, garments have been developed that have built-in safety harnesses. In many situations, the use of a combined garment and safety harness is preferred over the use of a separate harness because a combined garment and safety harness is generally more comfortable and is typically easier for a person to put on. Additionally, a combined garment and safety harness also protect a wearer's garments and skin therebeneath.

Typically, a combined garment and safety harness comprises a garment portion such as a vest or overalls, and a safety harness. The garment is typically formed of natural or synthetic flexible fabric or sheet material. The harness portion typically has some form of webbing comprised of strap material that is adapted and configured to hold many times the weight of a person. Moreover, the harness typically has some portion that is adapted and configured to be secured to a safety line.

Despite the benefits of combined garment and safety harnesses over more traditional safety harnesses, prior art combined garment and safety harnesses may be uncomfortable to use. Additionally, such combined garment and safety harnesses often do not provide the degree of protection desired in all situations. Furthermore, although generally easy to put on, such combined garment and safety harnesses can be difficult to attach to safety wires.

SUMMARY OF THE INVENTION

In view of the insufficiencies associated with prior art combined garment and safety harnesses, the inventors of the present invention have developed a combined garment and safety harness that is easy to put on and use and that provides superior protection from accidental falls. Additionally, in its preferred embodiment, the combined garment and safety harness of the present invention is easy to clean and comfortable to wear.

In first aspect of the invention, an apparatus comprises a garment portion and a harness portion. The garment portion is adapted and configured to be removably secured to a person's torso and comprises a back torso portion and a front torso portion, which together define an interior torso cavity therebetween. The garment portion further comprising left and right arm openings, left and right leg openings, and a neck opening that each extend into the interior torso cavity. The harness portion comprises a webbing and an attachment member. The webbing comprises a plurality of interconnected strap members. The attachment member has at least a partial loop and is secured to the webbing. The webbing forms a closed loop around and adjacent the left leg opening of the garment portion and a separate closed loop around and adjacent the right leg opening. At least one of the strap members of the webbing is positioned within the interior torso cavity of the garment portion and is secured to the garment portion. Moreover, at least a portion of harness portion extends through the back torso portion of the garment portion at a location between the neck opening and the left and right leg openings and between the left and right arm openings in a manner such that at least a portion of the attachment member is positioned in an environment external to the garment portion.

In another aspect of the invention, an apparatus comprises a garment portion and a harness portion. The garment portion is adapted and configured to be removably secured to a person's torso and comprises a back torso portion and a front torso portion, which together define an interior torso cavity therebetween. The garment portion further comprising left and right arm openings, left and right leg openings, and a neck opening that each extend into the interior torso cavity. The harness portion comprises a webbing and an attachment member. The webbing comprises a plurality of interconnected strap members. The attachment member has at least a partial loop and is secured to the webbing. The webbing forms a closed loop around and adjacent the left leg opening of the garment portion and a separate closed loop around and adjacent the right leg opening. At least one of the strap members of the webbing is positioned within the interior torso cavity of the garment portion and is secured to the garment portion. The strap members of the webbing include a groin strap member that directly connects the closed loop around the left leg opening with the closed loop around the right leg opening.

In yet another aspect of the invention, an apparatus comprises a garment portion and a harness portion. The garment portion is adapted and configured to be removably secured to a person's torso and comprises a back torso portion and a front torso portion, which together define an interior torso cavity therebetween. The front torso portion of the garment portion comprises left and right portions that are at least partially separable from each other. The garment portion further comprising left and right arm openings, left and right leg openings, and a neck opening that each extend into the interior torso cavity. The harness portion comprises a webbing and an attachment member. The webbing comprises a plurality of interconnected strap members. The attachment member has at least a partial loop and is secured to the webbing. At least one of the strap members of the webbing is positioned within the interior torso cavity of the garment portion and is secured to the garment portion. The strap members of the webbing include a pair of chest strap portions. The chest strap portions are selectively and releasably connectable to each other in a manner allowing the chest strap portions to secure the left portion of the front torso portion of the garment portion to the right portion of the front torso portion.

While the principal advantages and features of the invention have been described above, a more complete and thorough understanding of the invention may be obtained by referring to the drawings and the detailed description of the preferred embodiment, which follow.

Figure 1:
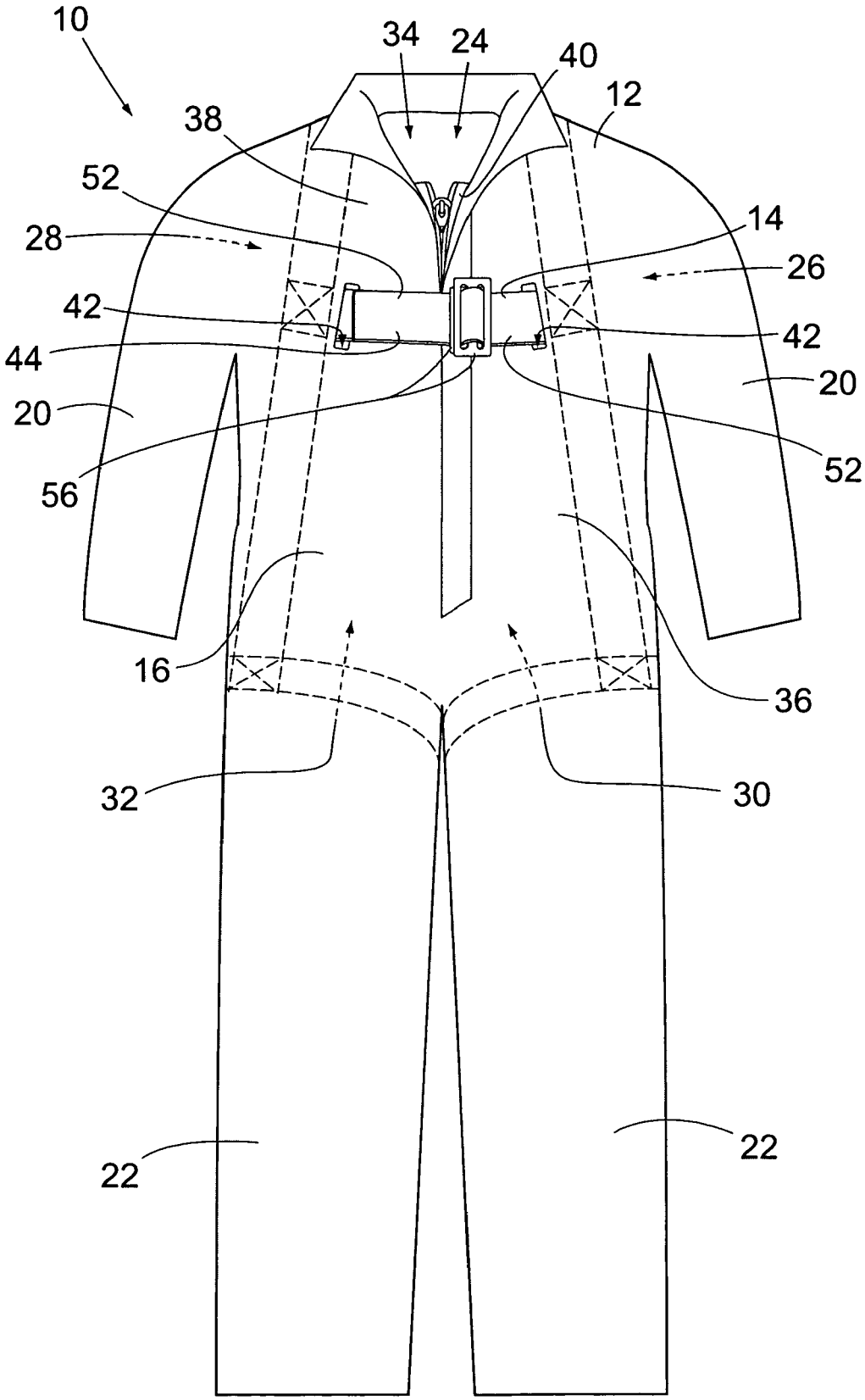
FIG. 1 is front view of the combined garment and safety harness of the preferred embodiment of the invention.

Reference characters in the written specification indicate corresponding items shown throughout the drawing figures.

DETAILED DESCRIPTION OF THE PREFERRED EMBODIMENT OF THE INVENTION

The preferred embodiment of a combined garment and safety harness in accordance with the invention is shown in the drawing figures. The combined garment and safety harness 10 primarily comprises a garment portion 12 and a harness portion 14. For purposes of clarity, the harness portion 14 of the combined garment and safety harness 10 is shown by itself in FIG. 4.

The garment portion 12 of the combined garment and safety harness 10 is formed primarily out of a woven flame retardant fabric material and comprises a front torso portion 16, a back torso portion 18, a pair of sleeves 20, and a pair of trouser legs 22. The front torso portion 16 and the back torso portion 18 are connected to each other and could be formed out of any number of separate fabric pieces, including a single piece, and also out of multiple materials. Additionally the sleeves 20 and trouser legs 22 could be formed out of any number of separate fabric pieces, including out of whatever piece or pieces also form the front 16 and back 18 torso portions. Preferably, the pieces that form the garment portion 12 are sewn to each other.

Assuming the garment portion 12 is not pressed flat, the front 16 and back 18 torso portions form an interior torso cavity 24 therebetween. Left 26 and right 28 arm openings, left 30 and right 32 leg openings, and a neck opening 34 extend into the interior torso cavity 24. Additionally, the front torso portion 16 comprises left 36 and right 38 portions that are partially separable from each other via a zipper 40 that extends downward from the neck opening 34. One of the sleeves 20 is attached to the left arm opening 26 and the other sleeve is attached to the right arm opening 28. Similarly, one of the trouser legs 22 is attached to the left leg opening 30 and the other trouser leg is attached to the right leg opening 32. Additionally, the back torso portion 18 of the garment portion 12 has a plurality of harness strap openings 42 that extend through the back torso portion. Similarly, the left portion 36 and the right portion 38 of the front torso portion 16 each have a harness strap opening 42 extending respectively therethrough.

The harness portion 14 of the combined garment and safety harness 10 comprises a webbing 44 and an attachment member 46. The webbing 44 comprises a plurality of interconnected strap members that are preferably formed of high strength flexible webbing material of the type well known in the art of safety harness manufacturing. The strap members of the webbing 44 preferably include a pair of leg strap members 48, a pair of crossover shoulder strap members 50, a pair of chest strap members 52, and a groin strap member 54.

Each of the leg strap members 48 forms a closed loop and are positioned within the interior torso cavity 24 of the garment portion 12 in a manner such that one of the leg strap members encircles and is adjacent the left leg opening 30 and the other of the leg strap members encircles and is adjacent the right leg opening 32. One of the crossover shoulder strap members 50 extends diagonally upward adjacent the back torso portion 18 from the leg strap member 48 around the left leg opening 30. As it so extends, the crossover shoulder strap member 50 passes through one of the harness strap openings 42 in the back torso portion 18 into an environment external to the garment portion 12, then connects to the attachment member 46 as described below, and thereafter passes back into the interior torso cavity 24 through another one of the harness strap openings. From this point, the crossover shoulder strap member 50 extends toward the front torso portion 16 at a location between the right arm opening 28 and the neck opening 34, and then extends downward where it ultimately attaches to the other leg strap member 48 around the right leg opening 32. The other crossover strap member 50 extends in a similar manner except with leg strap members 48 reversed and with the exception that it passes between the neck opening 34 and the left arm opening 26, rather than the right arm opening 28.

The chest strap members 52 extend toward each other adjacent the front torso portion 16 of the garment portion 12. In particular, one of the chest strap members 52 extends toward the opposite chest strap member within the interior torso cavity 24 until it reaches the nearest harness strap opening 42 in the front torso portion 16, at which point it extends through the harness strap opening into the environment external to the garment portion. From that point, the chest strap member 52 extends and ultimately attaches to a releasable connector 56. The other chest strap member 52 extends in a similar manner, but from the other of the crossover shoulder strap members 50. The connectors 56 to which the chest strap members 52 are attached are configured to be selectively and releasably interlocked with each other simply by passing one through the other after pivoting the connectors relative to each other. However, it should also be appreciated that any type of releasable connector could be utilized for this same purpose. Additionally, it should be appreciated that the position of at least one of the connectors along its respective chest strap member can be adjusted so as to tighten and loosen the chest straps when the combined garment and safety harness 10 is worn.

The groin strap member 54 simply extends from one of the leg strap members 48 to the other leg strap member. The groin strap member 54 preferably connects to the leg strap members 48 at locations where the leg straps are near each other, but not necessarily where the leg straps are nearest each other.

Figure 2:
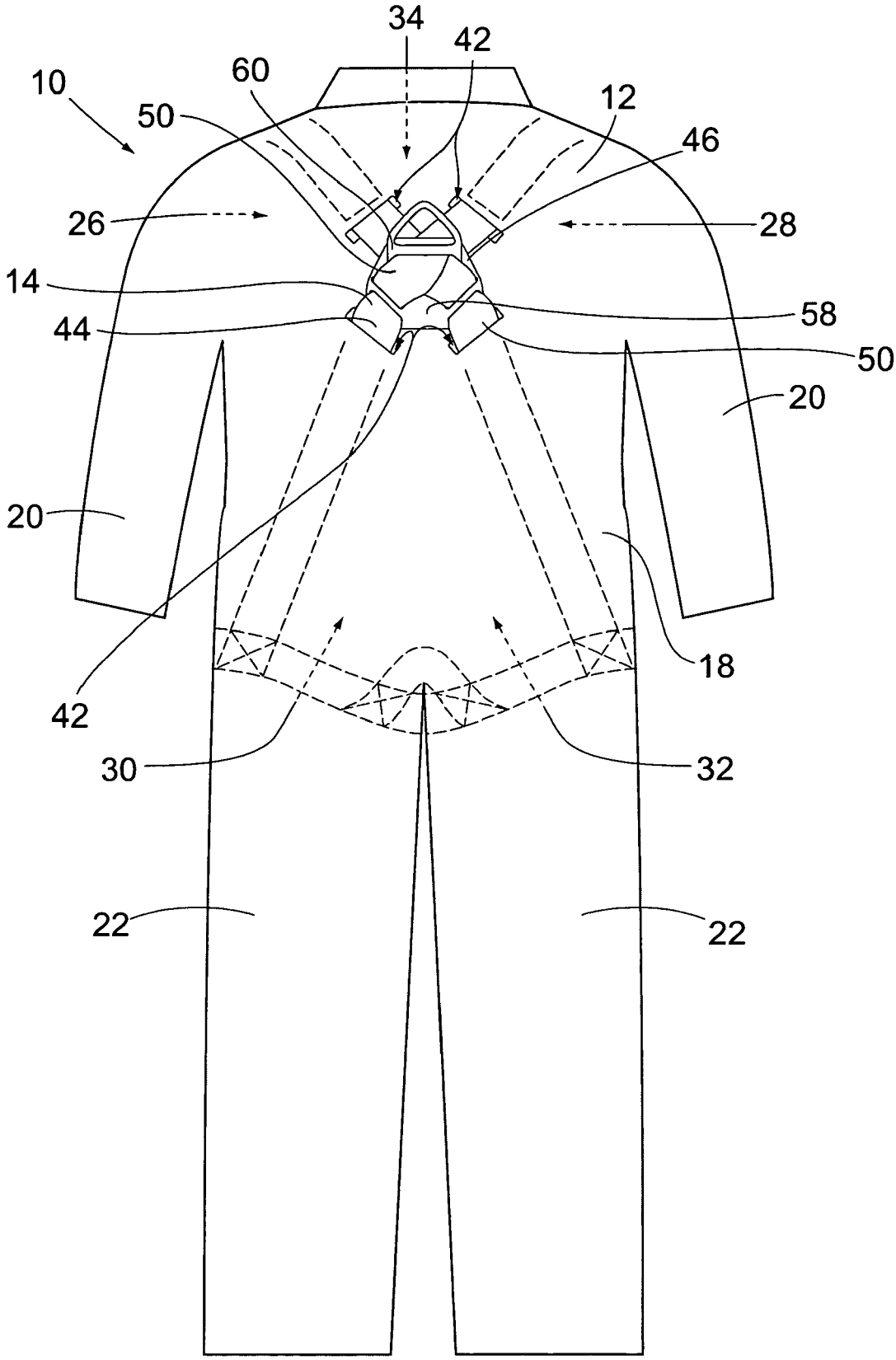
FIG. 2 is a back view of the combined garment and safety harness shown in FIG. 1.
Figure 3:
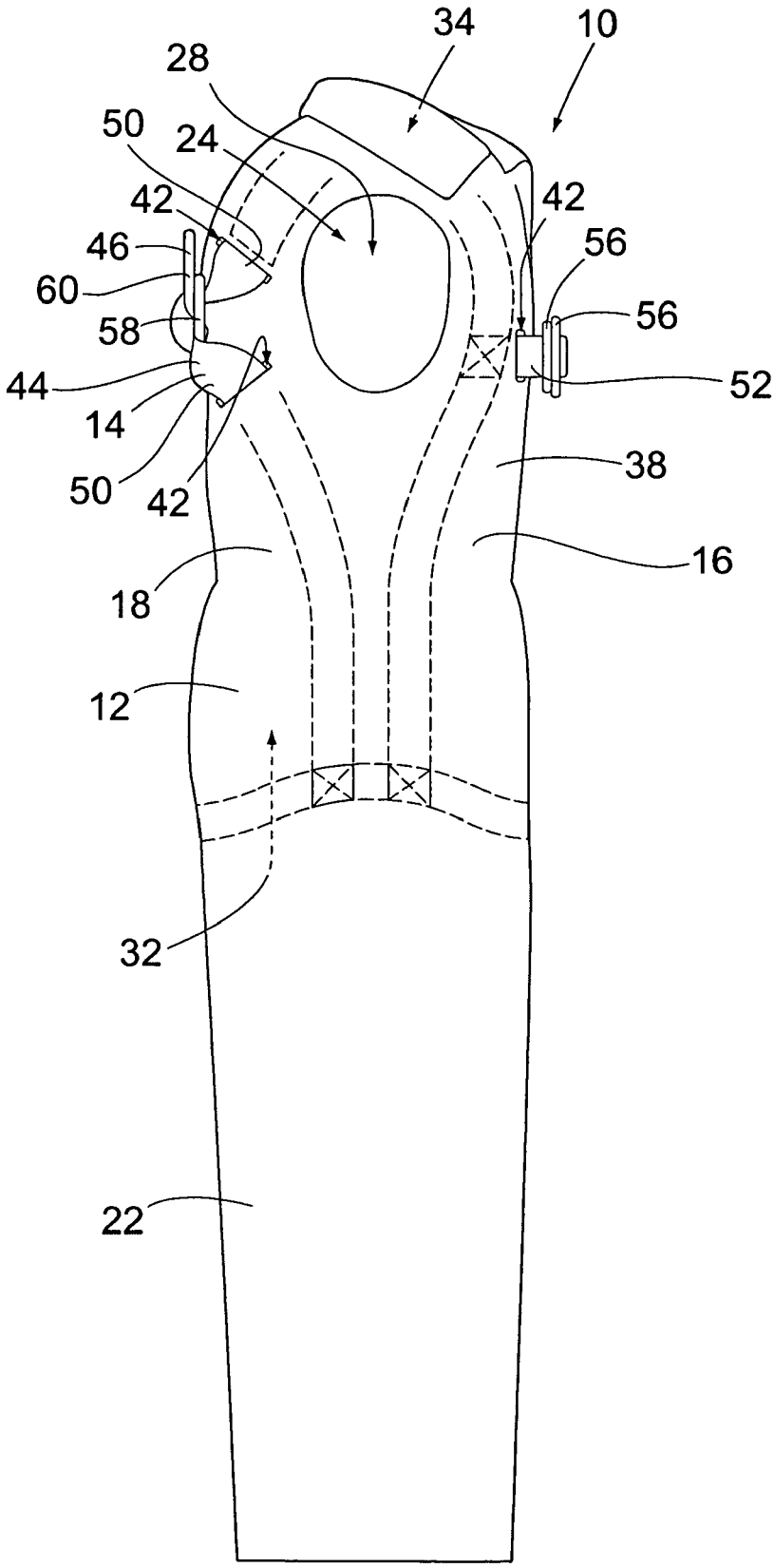
FIG. 3 is a side view of the combined garment and safety harness shown in FIG. 1, and is shown with a sleeve removed for clarity.
Figure 4:
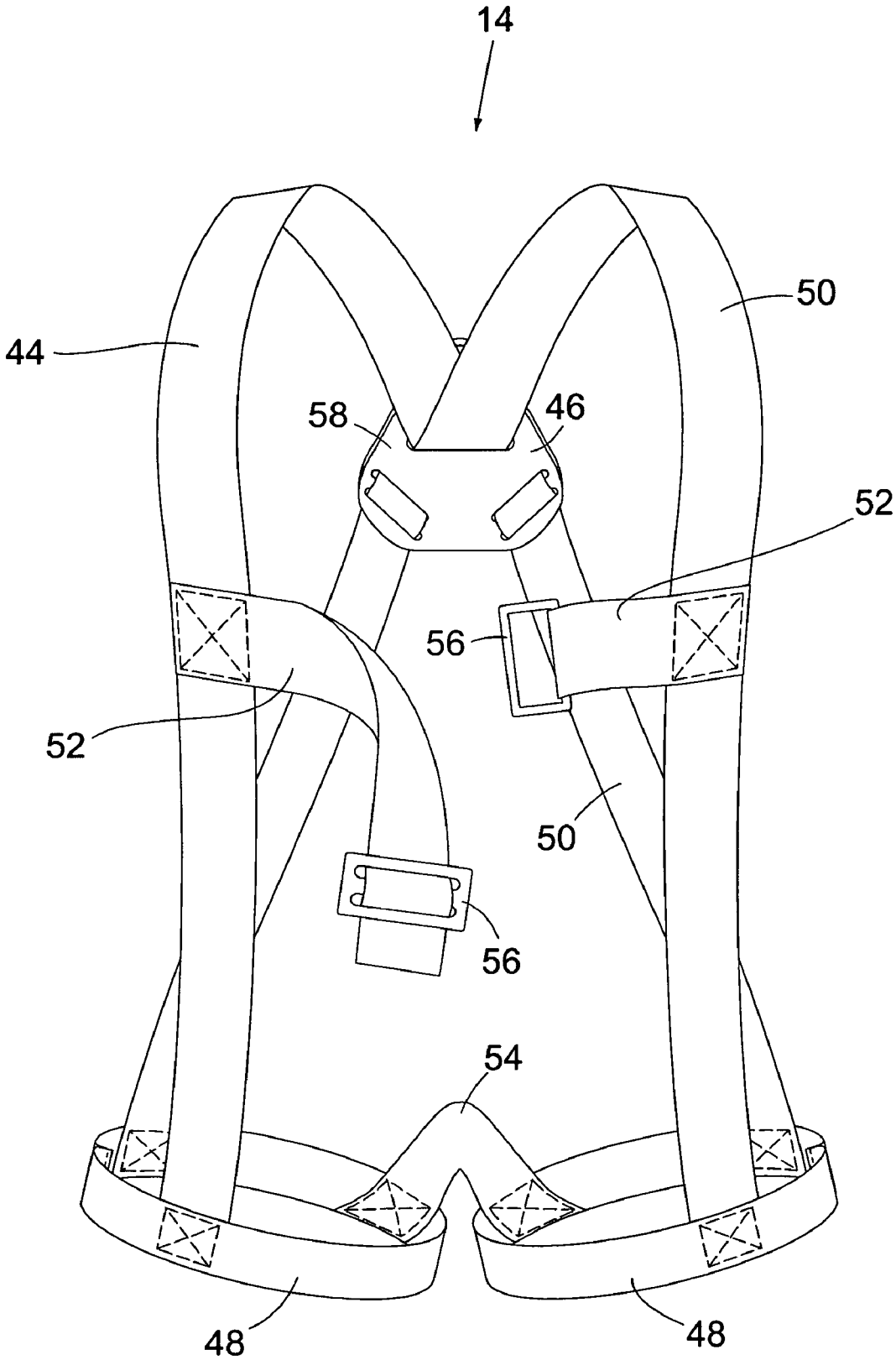
FIG. 4 is a perspective view of the harness portion of the combined garment and safety harness shown in FIG. 1.

The strap members of the webbing 44 of the harness portion 14 are preferably connected to each other by stitches, as shown in FIG. 4 (the stitches being represented by dashed lines). Additionally the strap members are also preferably stitched to the garment portion 12 of the combined garment and safety harness 10, as shown in FIGS. 1-3 (the stitches being represented by dashed lines). However, it should be appreciated that such connections could also be formed by rivets, heat fusion, staples, adhesives, or any other suitable fastening means and that the harness portion 14 could be attached to the garment portion 12 in more or less locations than shown in the drawing figures.

Figure 5:
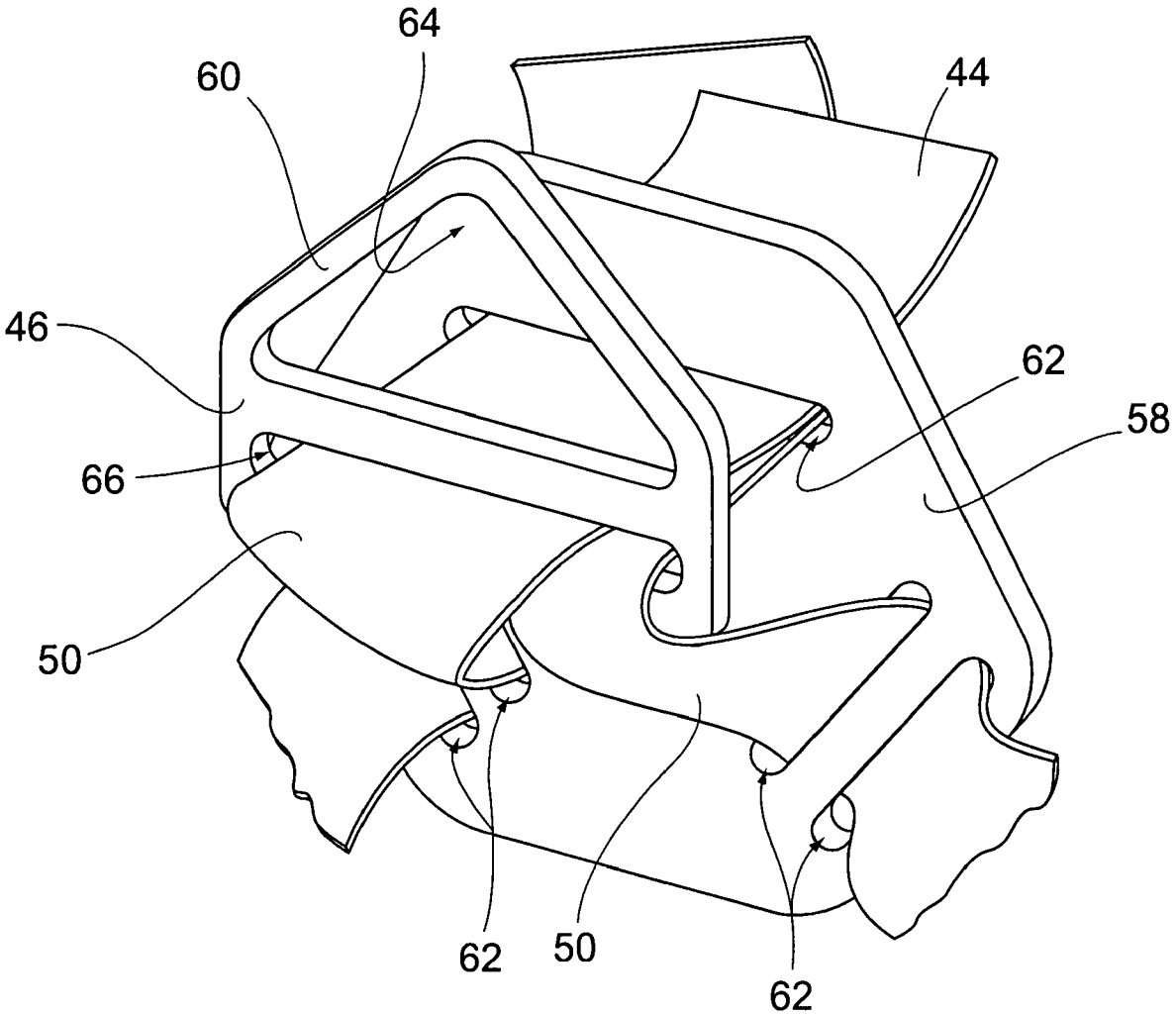
FIG. 5 is a detailed perspective view of the central portion of the back of the combined garment and safety harness shown in FIG. 1.

The attachment member 46 of the harness portion 14 preferably comprises a plate member 58 and a ring member 60 (as best shown in FIG. 5). The plate member 58 is preferably formed out of a rubber or plastic material and has a plurality of slots 62 extending therethrough. The ring member 60 is preferably formed out of a single piece of metal plate material and has a triangular opening 64 and an adjacent slot 66 therethrough. As such, the material of the ring member 60 forms a closed loop ring around the triangular opening 64. However, it should be appreciated that the attachment member could be a single piece and needs not have a triangular opening. For example, the attachment member could be lanyard clip, a strap member, or anything suitable for attaching the harness portion to a safety line.

The attachment member 46 is positioned in the environment external to the garment portion 12 at the location where the crossover shoulder strap members 50 intersect each other. The plate member 58 and a ring member 60 are attached to each other by passing the crossover shoulder strap members 50 through the slots 62 of the plate member and through the slot 66 of the ring member, as shown in FIG. 5. It should be appreciated that this also secures the attachment member 46 to the strap members 44 of the harness portion 14, and therefore to the garment portion 12 of the combined garment and safety harness 10. It should also be appreciated that the crossover shoulder strap members 50 shown in FIG. 5 are specifically shown loose so as to clarify the arrangement of the straps into and out of the slots 62,66 of the attachment portion 46 and that, once assembled, such strap members are preferably tightened to eliminate slack.

To put on the combined garment and safety harness 10, a person simply slips into the device in a manner similar to the way he or she would slip into traditional coveralls of course, when so doing, the releasable connectors 56 of the chest strap members 52 are not connected to each other and the zipper 40 on the front torso portion 16 of the garment portion 12 is unzipped so as to allow the left and right portions of the front torso portion to be partially separated from each other. Once on a person, the combined garment and safety harness 10 is secured to the wearer by simply pulling the zipper 40 upward. The combined garment and safety harness 10 can be further secured to the wearer by attaching the releasable connectors 56 of the chest strap members 52 to each other, thereby also securing the chest strap members to each other. It should also be appreciated that the slack in the attached chest strap members 52 can be adjusted to suit the wearer.

Once a person is wearing the combined garment and safety harness 10, he or she can easily be attached to a safety line by simply clipping a typical releasable connector provided at the free end of the safety line to the attachment member 46 of the harness portion 14. The closed loop of the plate member 58 of the attachment member 46, formed by the triangular opening 64 therethrough, provides a well suited attachment point and is positioned where it is comfortable, and where it will not jeopardize the wearer's safety should a fall occur. The flame retardant material utilized to form the garment portion 12 of the combined garment and safety harness 10 provides the wearer with protection from fire or flames and eliminates the need to wear additional fire protection garments over the combined garment and safety harness. Finally, the construction of the combined garment and safety harness 10 allows it to be washed as a single piece without removing the harness portion 14 from the garment portion 12. This is because, unlike other prior art combined garment and safety harnesses, the combined garment and safety harness 10 described above has few loose straps that could become snagged in some washing machines. Thus, these and other aspects of the combined garment and safety harness 10 provide advantages over other prior art combined garment and safety harnesses.

While the present invention has been described in reference to a specific embodiment, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, while the combined garment and safety harness of the preferred embodiment has open sleeves and open trouser legs, the sleeves could be attached to gloves formed integrally therewith and the trouser legs could be attached to boots formed integrally therewith. Likewise the neck opening could be integrally attached to a hood and/or a mask. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. An apparatus comprising:

a garment portion that is adapted and configured to be removably secured to a torso of a person, the garment portion comprising a back torso portion and a front torso portion, the back torso portion and the front torso portion defining an interior torso cavity therebetween, the garment portion further comprising left and right arm openings, left and right leg openings, and a neck opening that each extend into the interior torso cavity; and a harness portion, the harness portion being permanently attached to the garment portion, the harness portion comprising a plurality of interconnected strap members, the strap members including left and right leg strap members and first and second crossover shoulder strap members, the left leg strap member forming a closed loop around and adjacent the left leg opening of the garment portion and the right leg strap member forming a closed loop around and adjacent the right leg opening, the first crossover shoulder strap member being attached to the left leg strap member alongside the front torso portion of the garment and attached to the right leg strap member alongside the back torso portion of the garment, first crossover shoulder strap member extending upwardly from the first leg strap member alongside the front torso portion of the garment and upwardly from the second leg strap member alongside the back torso portion of the garment, the first crossover shoulder strap member being between the neck opening and the left arm opening as it passes from the front torso portion to the back torso portion, the second crossover shoulder strap member being attached to the right leg strap member alongside the front torso portion of the garment and attached to the left leg strap member alongside the back torso portion of the garment, the second crossover shoulder strap member extending upwardly from the right leg strap member alongside the front torso portion of the garment and upwardly from the left leg strap member alongside the back torso portion of the garment, the second crossover shoulder strap member being between the neck opening and the right arm opening as it passes from the front torso portion to the back torso portion.

2. An apparatus in accordance with claim 1 wherein the first and second crossover shoulder strap members are each sewn to each of the left and right leg strap members.

3. An apparatus in accordance with claim 1 wherein the first crossover shoulder strap consists of a single monolithic piece of strap material and the second crossover shoulder strap member consists of a single monolithic piece of strap material.

4. An apparatus in accordance with claim 3 wherein the left leg strap member consists of a single monolithic piece of strap material that is sewn to itself in a manner forming the closed loop around and adjacent the left leg opening, and the right leg strap member consists of a single monolithic piece of strap material that is sewn to itself in a manner forming the closed loop around and adjacent the right leg opening.

5. An apparatus in accordance with claim 1 wherein the left leg strap member consists of a single monolithic piece of strap material that is sewn to itself in a manner forming the closed loop around and adjacent the left leg opening, and the right leg strap member consists of a single monolithic piece of strap material that is sewn to itself in a manner forming the closed loop around and adjacent the right leg opening.

6. An apparatus in accordance with claim 5 wherein the first crossover shoulder strap member consists of a single monolithic piece of strap material and the second crossover shoulder strap member consists of a single monolithic piece of strap material, and the first and second crossover shoulder strap members are each sewn to each of the left and right leg strap members.

7. An apparatus in accordance with claim 1 wherein at least a majority of the harness portion is positioned within interior torso cavity of the garment portion.

8. An apparatus in accordance with claim 1 wherein another one of the strap members constitutes a groin strap member and is attached to and extends between the left and right leg strap members, the groin strap member is attached along the left leg strap member at a location between where the first crossover shoulder strap member is attached to the left leg strap member and where the second crossover shoulder strap member is attached to the left leg strap member, and the groin strap member is attached along the right leg strap member at a location between where the first crossover shoulder strap member is attached to the right leg strap member and where the second crossover shoulder strap member is attached to the right leg strap member.

9. An apparatus in accordance with claim 8 wherein the groin strap member is sewn to each of the left and right leg strap members.

10. An apparatus in accordance with claim 9 wherein the first crossover shoulder strap consists of a single monolithic piece of strap material and the second crossover shoulder strap member consists of a single monolithic piece of strap material.

11. An apparatus in accordance with claim 10 wherein the left leg strap member consists of a single monolithic piece of strap material that is sewn to itself in a manner forming the closed loop around and adjacent the left leg opening, and the right leg strap member consists of a single monolithic piece of strap material that is sewn to itself in a manner forming the closed loop around and adjacent the right leg opening, and the first and second crossover shoulder strap members are each sewn to each of the left and right leg strap members.

* * * * *